United States Patent [19]

Smith

[11] Patent Number: 4,796,564

[45] Date of Patent: Jan. 10, 1989

[54] CARRIER FOR SPRAYCOATING AUTO LIGHT COVERS

[76] Inventor: Francis M. Smith, 11060 Hupp, Warren, Mich. 48089

[21] Appl. No.: 837,890

[22] Filed: Mar. 10, 1986

[51] Int. Cl.[4] ..... B05C 11/14; B05C 13/00; B05C 13/02

[52] U.S. Cl. ..... 118/500; 269/289 R; 427/421

[58] Field of Search ..... 118/500; 269/37, 40, 269/266, 289 R; 427/421

[56] References Cited

U.S. PATENT DOCUMENTS 4,312,292 1/1982 Smith et al. ..... 108/500 X

*Primary Examiner*—Michael R. Lusignan

*Attorney, Agent, or Firm*—John R. Benefiel

[57] ABSTRACT

A disposable carrier is disclosed for supporting and positioning auto light covers during spray coating and heat curing of the coating, the carrier being reusable for extended periods by having a renewable upper surface to allow ready removal of accumulations of coating material overspray. The renewable upper surface comprises a plurality of stacked layers of absorbent paper each having aligned openings together defining a light cover receiving recess, each layer of which may be stripped away periodically, to expose a fresh absorbent surface. The absorbent paper layers are mounted on a support board, which also has mounted thereto center pieces fixed in the recesses to locate each light cover laterally.

11 Claims, 1 Drawing Sheet

CARRIER FOR SPRAYCOATING AUTO LIGHT COVERS

BACKGROUND OF THE INVENTION

This invention concerns work supports, and more particularly a carrier for locating and supporting one or more auto light covers for handling during spray coating material onto the outside surface of the cover.

DESCRIPTION OF THE PRIOR ART

The outside surface of auto light covers of molded plastic are sometimes sprayed with a coating material to improve the weathering characteristics thereof or to provide resistance to scratching or impact nicks from gravel or other road debris thrown up. That is, a urethane coating may sometimes be applied to the outer surface of the cover in order to provide a hardened coating and/or to reduce the transmission of ultraviolet radiation in sunlight and thereby avoid resultant color change in the plastic cover material. This technique avoids the need for utilizing more costly plastics for this application, and reduces the overall manufacturing costs for these items.

In spray coating the auto light covers, which are typically generally dome shaped, the outer domed side is positioned face up on a carrier. The spray coating operation is then conducted, which may require several spray coatings with intervening heat curing in an oven.

Heretofore, the practice has been to provide cardboard carrier support boards which are disposed of periodically as the coating material builds up on the adjacent surfaces with repeated uses. The build up of coating material on the adjacent carrier surfaces has presented a problem, since for many of the coating materials employed for such purposes, accumulation causes a flaking of the coating material from the surfaces adjacent the work piece as the spraying operation proceeds, flawing the finished coated surface of the cover.

Accordingly, an excessive replacement rate of the carriers is required. Alternatively the carrier must be cleaned of the overspray-caused build up of coating material, neither of which practice is economical.

Accordingly, it is an object of the present invention to provide a carrier for work pieces to be spray coated with material in which adjacent surfaces are renewable to eliminate the need either for too often disposal of the entire carrier, or for cleaning of the adjacent surfaces of the coating material.

It is a further object of the present invention to provide such carrier which is simple and low in cost to manufacture, and able to withstand the handling and heating cycles normally undergone in such applications for a reasonable number of uses such as to minimize the fixturing cost for such spray coating operations.

SUMMARY OF THE INVENTION

These and other objects of the present invention which will become apparent upon a reading of the following specification and claims are achieved by a carrier comprised of a planer support board having one or more center pieces affixed thereto, configured to receive the open side of the work piece thereover, such as to laterally locate the same in position on the upper side of the support board. Extending about the perimeter of the center pieces with an intervening space therebetween is a plurality of coating absorbent layers affixed atop a coextensive spacer layer attached to the support board. Each absorbent layer is loosely affixed to the other to form a vertical stack of detachable layers.

A work piece in position on a center piece is disposed within a recess defined by the stacked coating absorbent layers and the spacer layer surrounding the center piece. The topmost of the absorbent layers is located so that its surface intercepts and absorbs a great proportion of the coating material overspray, which accumulates on this surface.

After a number of cycles of use, the upper surface of the topmost layer may be renewed by detaching the topmost coating absorbent layer to expose a fresh, uncoated surface of the next below absorbent layer.

In an alternate embodiment, a groove is formed between the spacer layer located beneath the plurality of the absorbent layers which extends into close proximity to the center piece to define a narrow groove therebetween adapted to receive a downward projecting edge of the open side of the work piece such that a facing flange surface rests on an absorbent layer mounted atop and coextensive with the spacer layer, thereby masking the flange facing and preventing the coating material from being applied to the flange face.

The lower absorbent layer extends across intervening space between the stacked absorbent layers and workpiece, and the slight proportion of overspray of coating material is less apt to accumulate excessively on that surface; and to create a flaking problem, since it is substantially shielded from the spray of coating material.

In each embodiment, the carrier is constructed of die cut sheets of corrugated paperboard, and chip board is utilized as the coating absorbent material such as to provide a lightweight but structurally adequate carrier to minimize the fixturing costs.

DETAILED DESCRIPTION

The specific embodiments will be described in particular terminology employed for the sake of clarity, but is to be understood that the same is not intended to be limiting and indeed should not be so construed as the invention is capable of taking many forms and variations within the scope of the appended claims.

Figure 1:
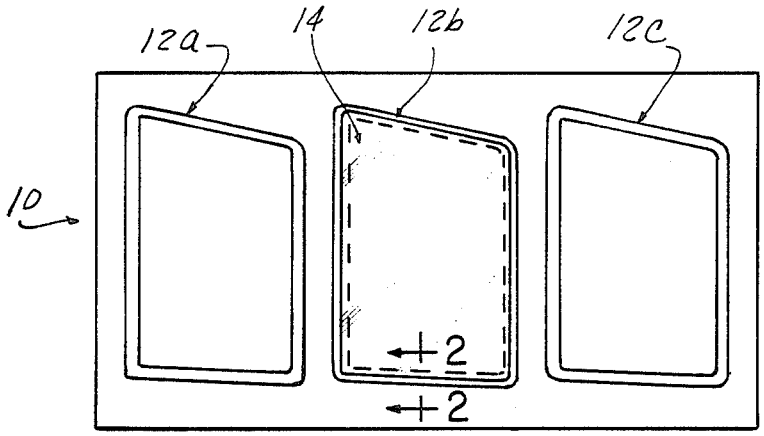
FIG. 1 is a plan view of a carrier according to the present invention showing the workpieces in location on the carrier.
Figure 2:
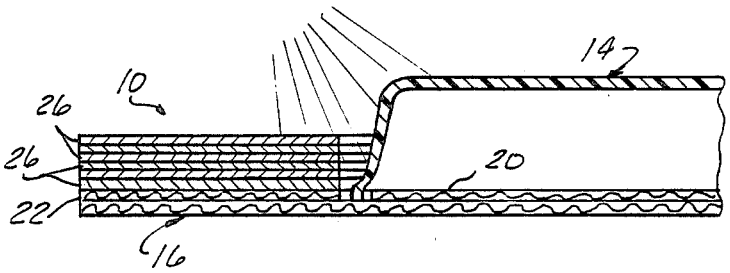
FIG. 2 is an enlarged fragmentary sectional view taken along the section 2—2 in FIG. 1.

Referring to the drawings, and particularly FIGS. 1 and 2, a carrier 10 according to the present invention is depicted which is adapted to accommodate three work pieces at carrier locations 12*a*, 12*b*, and 12*c*, with a work piece 14 shown in position at the central location 12*b*.

The carrier 10 includes a support board 16 preferably of cardboard such as 275 pound corrugated cardboard providing a generally planer support member.

A work piece 14 is of a generally dome shape having a cupped open side and as shown in FIG. 2, is positioned having its outer domed surface upward, with its open side facing downwardly positioned on the upper side 18 of the support board 16.

The work piece 14 is located laterally in position at the location 12 by means of a center piece 20 which may also be of corrugated cardboard and affixed by gluing and or stapling to the upper side 18 of the support board 16. The center piece 20 perimeter is shaped to be interfit with the interior edge of the open side of the work piece 14, with suitable clearance to accommodate tolerances, but allowing only limited lateral movement of the work piece 14. This essentially provides a location of the work piece 14 on the upper surface of the support board 16.

The center piece 20 is preferably formed by die cutting a second spacer layer 22 of a sheet of corrugated cardboard, with a strip die cut therein to form the centerpieces 20 in central regions of the sheet, affixing the layer 22 in its entirety to the topside 18 of the support board 16, and removing the strip shown in phantom at 24 at the left work station 120 to create an intervening space 25 between the center piece 20 and the remaining portion of the spacer layer 22. This method thereby provides efficient location of the center piece 20 on the support member 16.

Surrounding the perimeter of the work piece 14 and the center piece 20, with the intervening space 25, is a plurality of coating absorbent layers 26 which are loosely affixed to each other to form a vertical stack, with the bottommost layer secured to the corrugated spacer layer 22 to thus be mounted on the support board 16.

The coating absorbent material layers 26 have been found to able to be satisfactorily provided by a "chip board" material 0.024 inches thick, for the specific application described above. An adhesive is used to secure the parts together which is able to resist the curing oven temperatures on the order of 260° F. A packaging adhesive, number 201-0380 supplied by Nyatex Inc. of Howell, Mich., has been found satisfactory for this application.

Accordingly, it can be seen that the work piece 14 is thereby recessed within an opening defined by the interior perimeter of the aligned coating absorbent layers 26 and spacer layers 22, with an intervening space provided by removal of the strip 24.

When, the work piece 14 outer surface is spray coated, the great bulk of the coating overspray is deposited on the surface of the topmost of the plurality of the absorbent layers 26, as can be seen by the spray pattern in FIG. 2.

Thus, after a number of uses of the carrier 10, and accumulation of coating material on the upper surface of the topmost layer 26, the surface can be renewed and the excessive coating overspray removed quickly by merely stripping off the topmost of the plurality of absorbent layers 26 and so on until a surface may no longer be renewed after stripping all of the coating absorbent layers 26. At this point the carrier 10 can merely be discarded.

The recessing of the outer lower edge of the work piece 14 provides for efficient interception of the vast majority of paint overspray, alleviating the problem of flaking of excessive coating deposits by its periodic renewal.

In some instances, the bottom facing surface of the workpiece must remain free of the coating material, as to insure reliable ultrasonic welding or gluing of the face defining a mounting flange to the remaining portion of the auto light assembly. In these cases special care is to be taken to prevent spraying of coating material onto the flange face.

Figure 3:
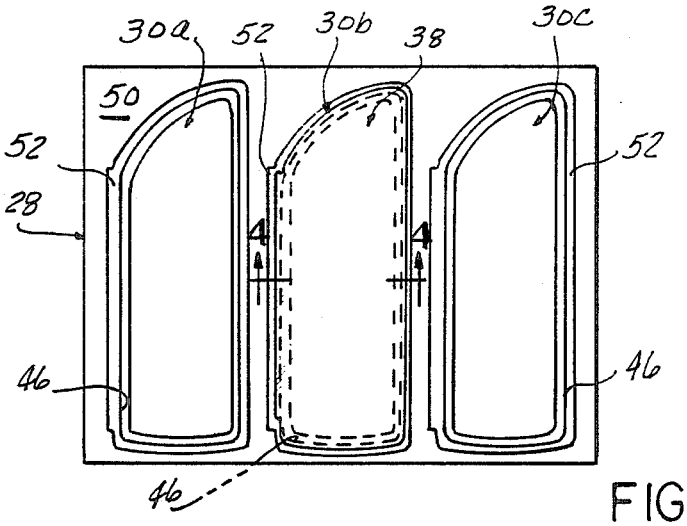
FIG. 3 is a plan view of an additional embodiment of the carrier according to the present invention showing a work piece in position on the carrier.
Figure 4:
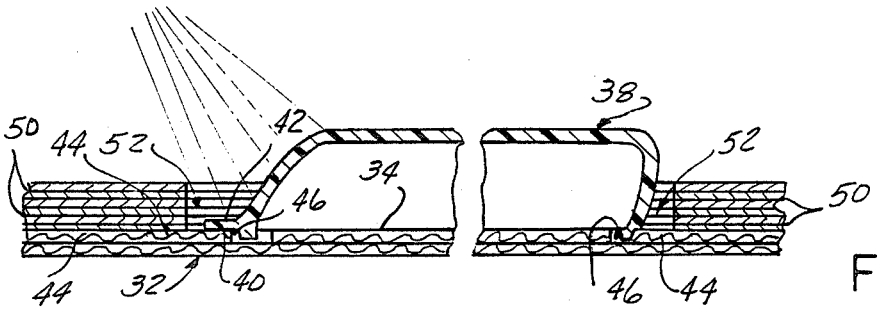
FIG. 4 is an enlarged fragmentary sectional view of section 4—4 taken in FIG. 3.

A modification of the carrier 10 according to the present invention, particularly adapted to this application is shown in FIGS. 3 and 4. In this case, carrier 28 similarly includes a three work piece locations 30*a*, 30*b*, and 30*c* spaced on a generally planer support board 32. A center piece 34 is affixed centrally at each workpiece location 30*a*, 30*b*, and 30*c* affixed to the upper surface 36 of the support board 32 and adapted to locate the work piece 38 laterally, at the work piece location 30*a*, 30*b*, or 30*c*.

In this instance, a flange face 40 is desired to remain as free from the coating material as possible, and thus a direct resting on a surface 42 is provided, by extending the interposed spacer layer 44 of corrugated material into close proximity with the center piece 34 by a removal of a much narrower strip to form a groove 46 between the center piece and interposed layer 44. The groove 46 accepts the lower cover edge protruding below the flange face 40. This allows the flange face 40 to rest directly on surface 42 comprised of the top side of an absorbent layer 44 extending beneath the plurality of stacked absorbent layers 50 and lying beneath adjacent space 52 between outer perimeter of the the work piece 38 and the plurality of coating absorbent layer 50.

In this case the absorbent layer 44 aids in absorbing any accumulated overspray coating material which is not intercepted by the inside edge of the topmost coating absorbent layer 50.

Accordingly, it can be appreciated that the carrier according to the present invention, provides an efficient fixturing for work pieces of the sort described in that the accumulation of coating material is able to be quickly removed for continued use of a given fixture over a large number of cycles of use. This is achieved by the use of vertically stacked coating absorbent layers which are arranged to form a recess into which the work piece is located with the topmost exposed surface of the absorbent layer interception the vast bulk of coating overspray from the spray directed at the work piece and accordingly upon removal of the topmost layer, the surface is renewed to avoid the problem of flaking, of excessive accumulated coating material as described above.

While specific materials have been described in order to provide a clear understanding to those skilled in the art, it is to be understood that other specific materials may be employed to suit the particular application as will be appreciated by those skilled in the art.

I claim:

1. A carrier for a work piece having a generally dome shaped outer surface and an open faced lower inside surface, to be spray coated with a coating material on the domed surface side, comprising:

a planar support board having an upper side adapted to receive said workpiece;

a locating center piece affixed to said support board configured to receive said hollow side of said workpiece to laterally locate said workpiece on said support board;

a renewable upper surface mounted on the upper side of said support board comprised of a plurality of layers of coating absorbent material loosely adhered to each other, whereby the topmost layer may be successively stripped away after continued exposure to coating overspray to present a renewed exposed surface adjacent said center piece.

2. The carrier according to claim 1 wherein each of said layers of absorbent material comprises chipboard paper.

3. The carrier according to claim 2 wherein said chip board paper layers are approximately .024 inches thick.

4. The carrier according to claim 1 wherein said layers of absorbent material are secured together with an adhesive.

5. The carrier according to claim 2 wherein each of said support board and center piece comprised of sheets of corrugated cardboard.

6. The carrier according to claim 1 further including a spacer layer affixed to the upper side of said support board of the same thickness as said centerpiece, extending from the perimeter of said support board to surround said centerpiece with a space therebetween and underlie said layers of absorbent material.

7. The carrier according to claim 6 further including a single layer of coating absorbent material extending beneath said plurality of layers absorbent material atop said spacer layer, said spacer layer and absorbent layer extending into said intervening space but with a gap between said layers and said center piece, whereby an upper absorbent surface is presented in said space intervening between said centerpiece and said plurality of absorbent layers.

8. The carrier according to claim 1 including a plurality of spaced center pieces affixed to said support board to accommodate a plurality of workpieces, said plurality of absorbent layers surrounding each of said center pieces with an intervening space therebetween.

9. The carrier according to claim 6 wherein said spacer board extends beneath said plurality of coating absorbent layers to be coextensive therewith.

10. A method of spray coating the outer surface of a plurality of auto light covers with a coating material comprising:

positioning each said covers on a carrier, said carrier comprised of a support board having a center piece affixed thereto configured to receive said cover thereover to laterally position said cover on said support board;

surrounding said center piece with a plurality of layers of absorbent material formed with an intervening space to accommodate each of said covers, said layers readily detachable from each other;

spray coating a succession of said covers while each is positioned on said center piece, and periodically removing a layer of absorbent material after continued build up of coating material on the top most absorbent layer.

11. The method according to claim 10 wherein said auto light cover is formed with flange face extending about the perimeter of said cover beneath said outer surface and an edge projecting from said flange face, said face to be not coated with said coating material, including the step of positioning a layer of absorbent material over an intervening space beneath said plurality of absorbent layers and said center piece to form a groove, and positioning said flange face over said absorbent layer in said intervening space with said edge disposed in said groove.

* * * * *